United States Patent [19]

Altherr

[11] 4,301,932

[45] Nov. 24, 1981

[54] TRAIN AIR LINE FITTING ATTACHMENT FOR TYPE E COUPLERS

[75] Inventor: Russell G. Altherr, Munster, Ind.

[73] Assignee: Amsted Industries Incorporated, Chicago, Ill.

[21] Appl. No.: 87,874

[22] Filed: Oct. 24, 1979

[51] Int. Cl.[3] ..... B61G 5/06

[52] U.S. Cl. ..... 213/76

[58] Field of Search ..... 213/76, 1 R; 24/237, 24/16; 248/53, 74

[56] References Cited

U.S. PATENT DOCUMENTS 3,344,935 10/1967 Stewart et al. ..... 213/76

3,556,314 1/1971 Punwani ..... 213/76

FOREIGN PATENT DOCUMENTS 134662 9/1933 Fed. Rep. of Germany ..... 213/76

1247217 10/1960 France ..... 213/76

*Primary Examiner*—Richard A. Bertsch

*Attorney, Agent, or Firm*—Edward J. Brosius; Fred P. Kostka; John L. Schmitt

[57] ABSTRACT

A bracket is provided as part of an "E" type railway coupler and located totally below and within the envelope of the coupler guard arm for attachment of an air line fitting. A hose is attached for coupling the air line to the adjacent car and to which another hose is attached for connection to the air line on the car body. The hose is oriented in the direction of the coupling line and supported in a position where the glad hand carried thereby is a controlled distance above the rail height.

9 Claims, 5 Drawing Figures

14
24
12
3
16
3
30
18
10

10
16
14
24
12
18
22
20
26
28

TRAIN AIR LINE FITTING ATTACHMENT FOR TYPE E COUPLERS

This invention relates in general to train air lines, and more particularly to the attachment of a train air line to a coupler of a car where the hose is required to accommodate the large longitudinal coupler travel.

BACKGROUND OF THE INVENTION

On railway cars having proportions that require a small lateral swing of the coupler to negotiate and which cars have standard gear which allows six and one-half inch longitudinal movement of the coupler, a standard twenty two inch hose is attached to the car mounted air line at the customary angle cock.

On a sliding sill car or a car with end-of-car cushioning where a long hose is required to accommodate the large longitudinal "E" coupler travel, the standard twenty two inch hose can not be attached to the angle cock on the car and be of a sufficient length of coupling to a like hose of an adjoining car.

In the past, train air line fittings were mounted on brackets that extended laterally from the coupler guard arm with the air line fittings and the brackets being susceptible to frequent damage due to bypassed couplers. Some type of support for the extra long hose is required and those currently recommended arrangements are reported to be damaged by the air line hose dragging.

OBJECT OF THE INVENTION

In accordance with this invention there is provided a novel bracket which is particularly adapted to be carried by a coupler in a position where it is not subject to damage during coupler bypassing and which bracket is particularly constructed to fixedly mount a fitting wherein a standard twenty two inch hose may be attached to the fitting, which fitting is, in turn, coupled by another hose to the angle cock carried by the car.

The bracket is particularly configurated to seat a fitting at a preselected position and angle so that the standard twenty two inch length hose connected to the fitting will, in a free hanging position, support the glad hand carried thereby at the required distance above the rail height. At the same time, the direction of the hose orientation is in the direction of coupling line to minimize hose strain during uncoupling.

The bracket is particularly configurated to be permanently attached on the underside of the coupler guard arm in a totally out of the way position.

With the above, and other objects in view that will hereinafter appear, the nature of the invention will be more clearly understood by reference to the following detailed description, the appended claims and the several views illustrated in the accompanying drawings.

Figure 1:
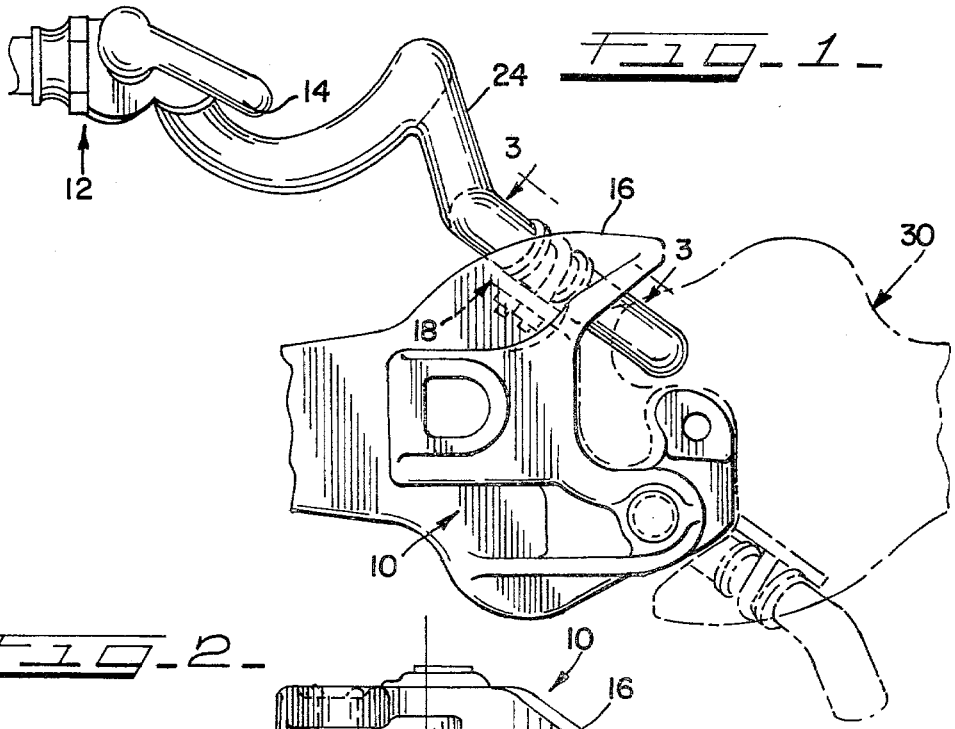
FIG. 1 is a plan view of an "E" coupler having mounted therein a bracket in accordance with the invention and the bracket, in turn, carrying a fitting coupling a hose to another hose.
Figure 2:
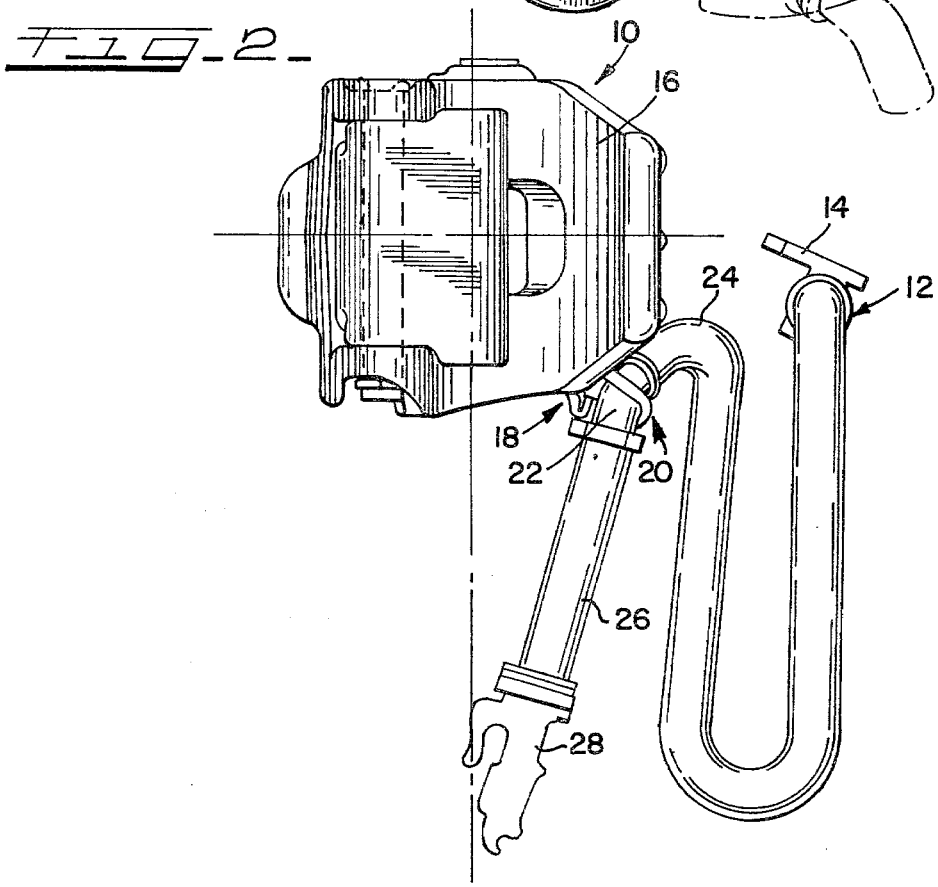
FIG. 2 is a front elevational view of the coupler of FIG. 1 and shows more specifically the mounting of the fitting and the hoses coupled thereto.

Referring now to the drawings in detail, it will be seen that there is illustrated in FIGS. 1 and 2 the general arrangement of a train air line in accordance with this invention. There is illustrated a coupler, generally identified by the numeral 10, which couplier is of the "E" type and is mounted relative to its respective train car (not shown) for a greater than normal longitudinal movement. The mounting of the coupler 10 with respect to the train car is such that a standard twenty two inch length hose at the angle cock can not be utilized.

Also illustrated is a customary angle cock, generally identified by the numeral 12 which is mounted on the car of which the coupler 10 is a part. The angle cock 12 is provided with a lever type actuator for selectively closing off flow through an air line associated therewith.

The coupler 10 is a conventional coupler and includes a guard arm 16. In accordance with this invention, there is suitably secured, such as by welding, to the underside of the guard arm 16 a mounting bracket, generally identified by the numeral 18. The mounting bracket 18 carries a standard U-bolt 20 which secures an angle fitting 22 in fixed position to the coupler 10. The angle fitting 22 has coupled to one end thereof a hose 24, the other end of which is coupled to the angle cock 12. The hose 24 is of a sufficient length to permit the necessary longitudinal shifting of the coupler 10 relative to the car.

A hose 26 is carried by the fitting 22 and is provided at its free end with the customary glad hand 28 for attachment to a like glad hand wherein the air lines between adjacent cars are coupled and thus the air line is continuous along the length of the train.

Without going into the details of the bracket 18 at this time, it is pointed out that the orientation of the fitting 22 is one wherein in the free hanging position of the hose 26, the glad hand is disposed generally in alignment with the intended position of the pivot center of a coupler 30 of a next adjacent car and at a height above rail height whereby damage to the glad hand 28 is prevented. At the same time, the hose 26 extends from the fitting 22 in the direction of the coupling line to minimize hose strain during uncoupling. The general orientation of the hose 26 in its free hanging position is clearly shown in FIG. 2.

In the alternative, if it is necessary to provide a hose of sufficient length such that the glad hand would extend below minimum rail clearance height, it will be necessary to provide a support means such as a chain to support the glad hand from the coupler head 10 in an uncoupled configuration.

Referring most particularly to FIGS. 1 and 2, it will also be seen that the bracket 18 and the fitting 22 carried thereby are disposed totally beneath the guard arm 16 of the coupler 10 so that in the event the coupler 30 should bypass the coupler 10 to the right, as viewed in FIG. 2, the coupler 30 would not engage either the fitting 22 or the bracket 18. Thereby accidental damage to the fitting, the hose and the bracket in the event of coupler bypassing is prevented.

Figure 3:
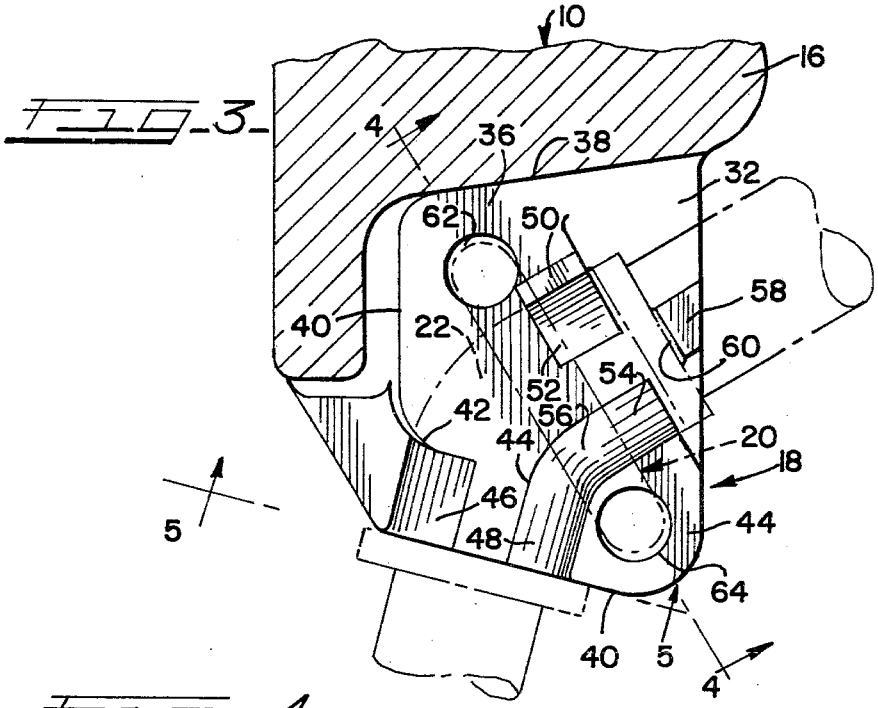
FIG. 3 is an enlarged fragmentary elevational view taken generally along the line 3—3 of FIG. 1 and shows the specific configuration of the bracket and the arrangement of projections thereon for the mounting of an angle fitting in accordance with the invention.
Figure 4:
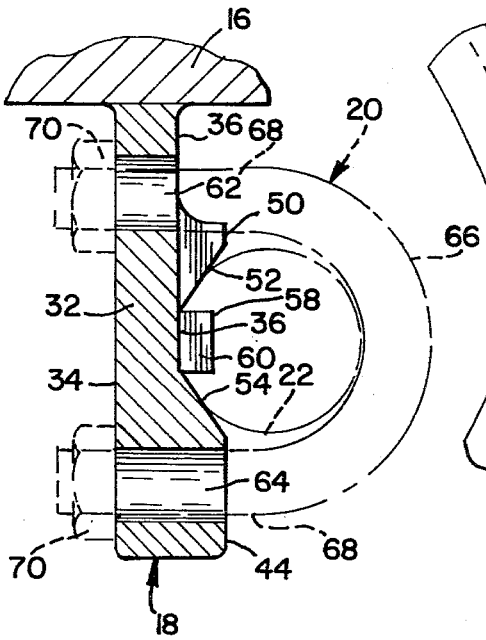
FIG. 4 is a transverse sectional view taken generally along the line 4—4 of FIG. 3 and shows more specifically the arrangement of the projecting surfaces and a U bolt to be carried by the bracket for securing the fitting in place thereon.
Figure 5:
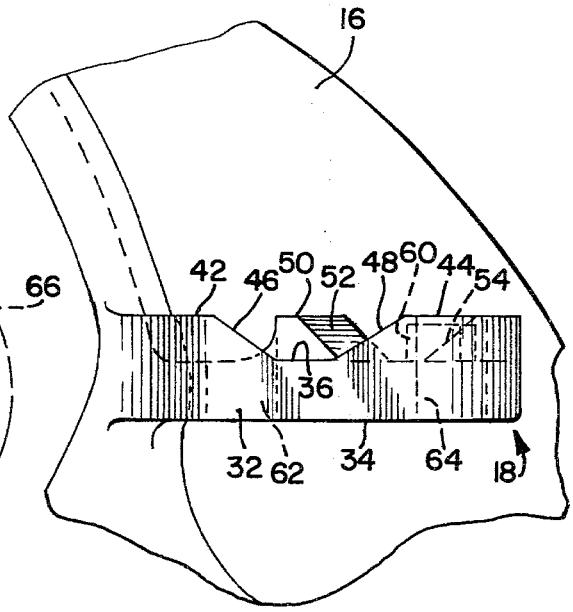
FIG. 5 is an edge view of the bracket taken generally along the line 5—5 of FIG. 3 and further shows the arrangement of the projecting surfaces on the bracket.

The bracket 18 is best illustrated in FIGS. 3, 4 and 5. The bracket 18 is preferably in the form of a cast plate-like member 32 which is generally rectangular in outline, as shown in FIG. 3. The plate-like member 32 has a planar rear face 34 and a front face 36 with a plurality of projecting surfaces thereon.

The plate-like member 32 has upper and front edge portions 38 and 40 particularly configurated for abutting engagement with the underside of the guard arm 16 whereby plate-like member 32 may be welded in place. In the alternative, plate-like member 32 may be casted as an integral portion of guard arm 16. The angular relationship of the bracket 18 with respect to the coupler 10 is best illustrated in FIG. 1.

The front face 36 is provided with a plurality of projections which include projections 42 and 44 disposed adjacent the lower edge 40. The projection 42 has a sloping projection surface 46 which terminates in the front face 36, as is best shown in FIG. 5. In a like manner, the projection 44 has a sloping surface 48 which converges with the sloping surface 46 and which merges into the front face 36 in spaced relation from the sloping surface 46. The sloping surfaces 46 and 48 together with the portion of the front face 36 disposed therebetween define a first seat.

Other projections on the front face 36 define a second seat which is disposed in angular relation from the first seat. These projections include a projection 50 and another portion of the projection 44. The projection 50 has a sloping surface 52 which slopes towards and terminates in the front face 36. The projection 44 has a second sloping surface 54 which is disposed in converging relation with respect to the sloping surface 52 and which intersects the front face 36 in spaced relation to the sloping surface 52. The sloping surfaces 52 and 54, together with the surface of the front face 36 disposed therebetween define the second seat.

As this time reference is made to FIG. 3 wherein it is shown that the sloping surfaces 44 and 54 are joined together by an arcuate outline sloping surface 56 so that in effect the projection 44 has a continuous sloping surface including sloping surface portions 48, 56 and 54.

The front face 36 has a further projection 58. The projection 58 has an upstanding stop surface 60 disposed transversely of the center line of the second seat. The stop surface 60 is intended to engage one end of the fitting 22 so as to facilitate the positioning of the fitting 22.

The mounting bracket 18 is provided with a pair of through apertures 62 and 64, the aperture 64 being formed through the projection 44. The apertures 62, 64 are joined along a line disposed generally parallel to the second seat.

As described above, a U-bolt 20 is carried by the bracket 18 and secures the fitting 22 thereto. The U-bolt 20, as is best illustrated in FIG. 4, includes a bight portion 66 and a pair of legs 68, the legs 68 extending through the apertures 62, 64 while the bight portion 66 engages the fitting 22. The legs 68 carry on the rear face 34 of the bracket 18 suitable nuts threadedly engaged thereon for tightly clamping the fitting 22 in place.

It is to be understood that the various projections projecting from the front face 36 of the bracket 18 are particularly configurated for engagement with the illustrated fitting 22. Should the fitting 22 be modified, then the projections would also be modified to fit that fitting.

Although only a preferred embodiment of the mounting bracket and hose mounting arrangement has been illustrated and described specifically herein, it is to be understood that minor variations may be made in the bracket and the mounting of the train air line hose without departing from the scope of the invention as defined by the appended claims.

I claim:

1. A bracket for use in mounting a train air line fitting to the underside of an E type railway coupler having a guard arm, said bracket comprising a plate-like member having front and rear faces, apertures in said plate-like member for receiving legs of a fastener of the U-bolt type, and a plurality of projecting surfaces on said front face spaced from and oriented relative to said aperture defining seat means for receiving a train air line fitting to be secured to said bracket by said fastener, means for fixedly securing said bracket to said guard arm in a position located totally below said guard arm.

2. The bracket of claim 1 and a train air line fitting fixedly secured to said bracket by a single U-bolt having a bight portion engaging said fitting and a pair of legs passing through said apertures.

3. The bracket of claim 2 and a standard length hose carrying a conventional glad hand, said hose being connected to and carried by said fitting.

4. The bracket of claim 3 wherein said hose extends from said fitting at a selected angle and height to position said glad hand in a free hanging position of said hose above rail height with the hose oriented in the direction of coupling line to minimize hose strain during uncoupling of train cars.

5. The bracket of claim 4 wherein said fitting is an angle fitting.

6. A bracket for use in mounting a train air line fitting to the underside of an E type railway coupler, said bracket comprising a plate-like member having front and rear faces, apertures in said plate-like member for receiving legs of a fastener of the U-bolt type, and projecting surfaces on said front face oriented relative to said apertures for forming seat means for a train air line fitting to be secured to said bracket, said seat means includes a pair of spaced seats to receive an angle fitting and each includes a pair of said projecting surfaces.

7. The bracket of claim 6 wherein said projecting surfaces have sloping converging surfaces terminating in said front face in spaced relation.

8. The bracket of claim 7 wherein one projecting surface of one of said seats is a continuation of a like one of said projecting surface of the other of said seats.

9. The bracket of claim 7 wherein said projecting surface includes a stop associated with one of said seats for positioning a fitting relative to said seats.

* * * * *